US006764647B2

(12) United States Patent
Aigner et al.

(10) Patent No.: US 6,764,647 B2
(45) Date of Patent: Jul. 20, 2004

(54) CORROSION RESISTANT MATERIAL

(75) Inventors: Herbert Aigner, Buchbach (AT); Josef Bernauer, Kapfenberg (AT); Gabriele Saller, Leoben (AT)

(73) Assignees: Choeller-Bleckmann Oilfield Technology GmbH & Co. KG, Ternitz (AT); Kohler Edelstahl GmbH, Kapfenberg (AT)

( * ) Notice: Subject to any disclaimer, the term of this patent is extended or adjusted under 35 U.S.C. 154(b) by 0 days.

(21) Appl. No.: 10/182,725

(22) PCT Filed: Jun. 8, 2001

(86) PCT No.: PCT/AT01/00188

§ 371 (c)(1),
(2), (4) Date: Aug. 12, 2002

(87) PCT Pub. No.: WO02/02837

PCT Pub. Date: Jan. 10, 2002

(65) Prior Publication Data

US 2003/0024612 A1 Feb. 6, 2003

(30) Foreign Application Priority Data

Jun. 30, 2000 (AT) ..... 1133/00

(51) Int. Cl.[7] ..... C22C 38/42; C22C 38/44; C21D 8/00

(52) U.S. Cl. ..... 420/586.1; 148/650; 148/651; 420/45; 420/49

(58) Field of Search ..... 148/442, 650, 148/651, 707, 419, 327; 420/45, 49, 586.1

(56) References Cited

U.S. PATENT DOCUMENTS

| | | | |
|---|---|---|---|
| 4,201,575 | A | 5/1980 | Henthorne et al. |
| 4,400,349 | A | 8/1983 | Kudo et al. |
| 4,421,571 | A | 12/1983 | Kudo et al. |
| 4,824,638 | A | 4/1989 | Culling |
| 4,876,065 | A | 10/1989 | Rockel et al. |
| 5,695,716 | A | 12/1997 | Köhler et al. |

FOREIGN PATENT DOCUMENTS

| | | |
|---|---|---|
| DE | 2700574 | 7/1977 |
| DE | 3223457 | 1/1983 |
| DE | 3224865 | 1/1983 |
| EP | 0292061 | 11/1988 |
| EP | 0657556 | 6/1995 |
| EP | 0913491 | 5/1999 |
| JP | 64-47817 | 2/1989 |

OTHER PUBLICATIONS

English Language Abstract of EP 0 913 491.

Patent Abstracts of Japan, vol. 013, No. 238 (C–603).

English Translation of the passage from p. 2 (office numbering) to p. 3, line 10 of document DE 27 00 574 A1.

Chemical Abstracts, vol. 110, No. 12, Abstract No. 99455b, Mar. 20, 1989, Charles, J. et al.: "Superaustenitic stainless steels for marine applications".

"Stahlschlüssel", 18th ed. 1998, Verlag Stahlschlüssel Wegst GmbH, p. 239.

*Primary Examiner*—Deborah Yee
(74) *Attorney, Agent, or Firm*—Greenblum & Bernstein, P.L.C.

(57) ABSTRACT

A material which is suitable for equipment in oilfield technology and a process for making the material. The material consist essentially of C, Si, Mn, Cr, Mo, Ni, Cu, N in certain weight percentages, with the balance iron and contaminants due to manufacture. The material is hot formed in a condition free of nitride precipitates and without precipitated associated phases. After a cooling, it is cold formed in a condition free of ferrites. The material has certain values of relative magnetic permeability, yield strength ($R_{p0.2}$), notched impact strength, fatigue strength under reversed stresses, and fracture appearance transition temperature.

40 Claims, No Drawings

CORROSION RESISTANT MATERIAL

CROSS-REFERENCE TO RELATED APPLICATIONS

The present application is a National Stage Application of International Application No. PCT/AT01/00188, filed Jun. 8, 2001 which was published under PCT Article 21(2) in German. Further, the present application claims priority under 35 U.S.C. § 119 of Austrian Patent Application No. A 1133/00 filed on Jun. 30, 2000. Both of these applications are incorporated herein by reference in their entireties.

BACKGROUND OF THE INVENTION

1. Field of the Invention

The invention relates to a material with a high corrosion resistance in media with a high chloride concentration, suitable for equipment in oilfield technology, in particular for drilling line components, comprising the elements carbon (C), silicon (Si), manganese (Mn), chromium (Cr), molybdenum (Mo), nickel (Ni), copper (Cu), nitrogen (N), iron (Fe) and contaminants due to manufacture, which material is hot formed and, after cooling, is cold formed.

2. Discussion of Background Information

Corrosion resistant materials which show paramagnetic behavior and feature a high degree of strength, can be used for equipment in oil field technology, particularly for drilling line components. However, higher demands are always being made on the parts and stricter standards are always being set for the materials.

In order to be able to conduct directional measurements during the sinking or boring of a drill-hole with the necessary precision, the material must have a permeability of less than 1.005.

A high mechanical strength, in particular a high 0.2% elongation value, is necessary in view of an advantageous design in terms of industrial engineering and of high operational safety of the parts, because it is intended to stress same up to the limiting values of the respective material load capacity, and because increasingly large drilling depths are required. Furthermore, a notched impact strength of the material is important, because the parts often have to withstand high stresses in the form of impacts or shocks.

A high fatigue strength under reversed stresses is important in many cases, in particular for drilling line parts and drill stems, because increasing or changing stresses can be present during a rotation of the parts or of the drill stems, respectively.

The parts are often installed or used at low temperatures so that the fracture appearance transition temperature (FATT) of the material also plays an important role.

The corrosion behavior for parts used in oilfield technology is of crucial importance, that is, on the one hand stress corrosion cracking (SCC) and on the other pitting corrosion (pitting, CPT).

As shown by the above statements, materials which have a high degree of corrosion resistance in media with a high chloride concentration and are suitable for equipment in oilfield technology are simultaneously exposed to a plurality of high stresses.

SUMMARY OF THE INVENTION

The object of the invention is to provide a paramagnetic material with a high yield strength, high notched impact strength and high fatigue strength under reversed stresses as well as a low fracture appearance transition temperature, which at the same time is corrosion-resistant, in particular resistant to pitting, in chloride-containing media.

This object is attained with a material of the type mentioned at the outset by this consisting essentially of the elements in percent by weight

| | |
|---|---|
| Carbon (C) | less than/equal to 0.03 |
| Silicon (Si) | less than/equal to 0.89 |
| Manganese (Mn) | 0.51 to 4.49 |
| Chromium (Cr) | 25.1 to 38.9 |
| Molybdenum (Mo) | 2.1 to 5.9 |
| Nickel (Ni) | 22.9 to 38.9 |
| Copper (Cu) | 0.51 to 1.49 |
| Nitrogen (N) | 0.17 to 0.29 |
| Iron (Fe) | balance |

and contaminants due to manufacture, which material is hot formed in a condition free of nitride precipitates and without precipitated associated phases and, after a cooling, cold formed in a condition free of ferrites, and having a permeability of less than 1.0048
a yield strength ($R_{p0\ 2}$) of more than 710 N/mm$^2$
a notched impact strength of over 60 J
a fatigue strength under reversed stresses of more than ±310 N/mm$^2$
at N=10$^7$ load reversal and
a fracture appearance transition temperature of less than −28° C. (FATT).

Accordingly, the present invention provides a material which is suitable for equipment in oilfield technology. This material consists essentially of the following elements, in percent by weight, ≦0.03 C; ≦0.89 Si; 0.51 to 4.49 Mn; 25.1 to 38.9 Cr; 2.1 to 5.9 Mo; 22.9 to 38.9 Ni; 0.51 to 1.49 Cu; and 0.17 to 0.29 N, with the balance iron and contaminants due to manufacture. The material is hot formed in a condition free of nitride precipitates and without precipitated associated phases. Moreover, after a cooling, the material is cold formed in a condition free of ferrites. The material has a relative magnetic permeability of less than 1.0048 $\mu r$, a yield strength ($R_{p0.2}$) of higher than 710 N/mm$^2$, a notched impact strength of higher than 60 J, a fatigue strength under reversed stresses of at least ±310 N/mm$^2$ at N=10$^7$ load reversal, and a fracture appearance transition temperature (FATT) of below −28° C.

In one aspect, the material contains any of the elements in the following weight percentages: C≦0.02, e.g., 0.01 to 0.02; Si≦0.75, e.g., 0.20 to 0.70; Mn 1.1 to 2.9, e.g., 2.01 to 2.6; Cr 26.1 to 27.9, e.g., 26.5 to 27.5 ;Mo 2.9 to 5.9, e.g., 3.2 to 3.8; Ni 27.9 to 32.5, e.g., 30.9 to 32.1; Cu 0.98 to 1.45, e.g., 1.0 to 1.4; and N 0.175 to 0.29, e.g., 0.18 to 0.22.

In another aspect, the material is hot formed at least 3.6-fold and/or cold formed with a degree of forming of less than 38%, e.g., 6 to 19%. In the case of cold forming, the forming temperature may be from 100 to 590° C., e.g., from 360 to 490° C. For example, the material may be hot formed at least 3.6-fold and cold formed with a degree of forming of 6 to 19% at a temperature ranging from 360 to 490° C.

In another aspect, the material has a pitting potential in a neutral solution at room temperature of more than 1,100 mVH/1,000 ppm chlorides and/or more than 1,000

The present invention also provides a drilling line component and a drill stem comprising the above material.

A further aspect of the present invention is represented by a process for making a material suitable for equipment in oilfield technology and having a relative magnetic permeability of less than 1.0048 $\mu r$, a yield strength ($R_{p0.2}$) of higher than 710 N/mm$^2$, a notched impact strength of higher than 60 J, a fatigue strength under reversed stresses of at least ±310 N/mm$^2$ at N=10$^7$ load reversal and a fracture appearance transition temperature (FATT) of below −28° C. The process comprises hot forming a material which consists essentially of, in percent by weight, ≦0.03 C; ≦0.89 Si; 0.51 to 4.49 Mn; 25.1 to 38.9 Cr; 2.1 to 5.9 Mo; 22.9 to 38.9 Ni; 0.51 to 1.49 Cu; and 0.17 to 0.29 N, with the balance iron and contaminants due to manufacture, in a condition free of nitride precipitates and without precipitated associated phases and, after a cooling, cold forming the material in a condition free of ferrites.

In one aspect, the material contains any of the elements in the following weight percentages: C≦0.02, e.g., 0.01 to 0.02; Si≦0.75, e.g., 0.20 to 0.70; Mn 1.1 to 2.9, e.g., 2.01 to 2.6; Cr26.1 to 27.9, e.g., 26.5 to 27.5;Mo 2.9 to 5.9, e.g., 3.2 to 3.8; Ni 27.9 to 32.5, e.g., 30.9 to 32.1; Cu 0.98 to 1.45, e.g., 1.0 to 1.4; and N 0.175 to 0.29, e.g., 0.18 to 0.22.

In another aspect, the process comprises hot forming the material at least 3.6-fold and/or cold forming it with a degree of forming of less than 38%, e.g., 6 to 19%. In the case of cold forming, the forming temperature may be from 100 to 590° C., e.g., from 360 to 490° C. For example, the material may be hot formed at least 3.6-fold and cold formed with a degree of forming of 6 to 19% at a temperature ranging from 360 to 490° C.

The advantages achieved by the invention lie in particular in the alloying technology effect of a balanced nitrogen concentration. Surprisingly, it was found that a particularly high output can be achieved in the manufacture of parts. Although there cannot be any nitride precipitates with a hot forming, the forming property of the material at a varying forging temperature is abruptly impaired at contents of over 0.29 percent by weight nitrogen. In the narrow concentration range of 0.17 to 0.29 percent by weight N a precipitation of associated phases can also be easily prevented if the other alloying elements are present in the provided content ranges. Nitrogen, nickel and molybdenum thereby also synergistically produce an extremely high resistance to pitting.

At 0.03 percent by weight, the carbon content of the alloy has an upper limit for corrosion chemistry reasons, with a further reduction thereof increasing the corrosion resistance of the material, in particular pitting and stress corrosion cracking.

The silicon content in the material according to the invention should not exceed 0.89 percent by weight for corrosion chemistry reasons and in particular because of the low magnetic permeability.

The nitrogen solubility of the alloy and the austenite stabilization are promoted by manganese. However, to prevent pitting, the manganese contents must have an upper limit of 4.49 percent by weight with nickel being added to the alloy instead. A minimum content of 0.51 percent by weight manganese is necessary for an effective sulfur binding.

One of the particularly important alloying elements with regard to corrosion resistance is chromium, because chromium is the basis for forming a passive layer on the surface of the parts. Contents of at least 25.1 percent by weight Cr are necessary in synergistic effect with the other alloying elements, in particular Mo and N, in order to largely prevent a possible piercing of this layer in places. With contents higher than 38.9 percent by weight the danger of a precipitation of intermetallic phases increases.

Although the alloying element molybdenum is extremely important for a resistance of the material to crevice and pitting corrosion, the content should not exceed 5.9 percent by weight, because then there is a sudden increased tendency to form associated phases. Contents lower than 2.1 percent by weight impair the corrosion behavior of the material disproportionally.

The alloying element nickel is important in the provided concentrations for stabilizing the cubic face-centered atomic lattice, thus for low permeability, and interacting with chromium and molybdenum it is effective for avoiding pitting corrosion. Up to 38.9 percent by weight, the toughness, the FATT and the fatigue strength under reversed stresses are advantageously increased. If it falls below 22.9 percent by weight, the stabilizing effect regarding corrosion, in particular stress corrosion cracking, is reduced to an increasing extent in chloride-containing media and with respect to the magnetic values in cold working; thus there is an increased tendency to form zones with strain-induced martensite.

A copper content within the limits of the alloy is also provided to increase corrosion resistance, even though the effect of this element has occasionally been questioned.

As mentioned earlier, the nitrogen content is synergistically adapted to the remainder of the alloy composition. This content of 0.17 to 0.29 percent by weight has the further advantage that a block can be left to solidify under atmospheric pressure without gas bubbles being formed therein by exceeding the solubility limit during solidification.

The magnetic, the mechanical and in particular the corrosion resistance values of the material can be set at a particularly high level, if it consists essentially of the elements in percent by weight:

| | |
|---|---|
| C = | less than/equal to 0.02, preferably 0.005 to 0.02 |
| Si = | less than/equal to 0.75, preferably 0.20 to 0.70 |
| Mn = | 1.1 to 2.9., preferably 2.01 to 2.6 |
| Cr = | 26.1 to 27.9, preferably 26.5 to 27.5 |
| Mo = | 2.9 to 5.9, preferably 3.2 to 3.8 |
| Ni = | 27.9 to 32.5, preferably 30.9 to 32.1 |
| Cu = | 0.98 to 1.45, preferably 1.0 to 1.4 |
| N = | 0.175 to 0.29, preferably 0.18 to 0.22 |

Fe and contaminants due to manufacture = balance.

High mechanical property values at a relative magnetic permeability of 1.004 and below are achieved when the material is hot formed at least 3.6-fold in a condition free of precipitates and is cold formed at a temperature of 100 to 590° C., preferably 360 to 490° C., with a degree of forming of less than 38%, preferably 6 to 19%. According to the invention the material features a pitting corrosion potential in a neutral solution at room temperature of more than 1,100 mVH/1,000 ppm chlorides and/or 1,000 mVH/80,000 ppm chlorides.

DESCRIPTION OF THE INVENTION

The invention is explained in more detail using examples.

Table 1 shows the chemical composition of the alloys according to the invention and the comparison materials. The characteristic values for hot forming and cold forming the forged pieces can also be taken from this table.

The magnetic and the mechanical characteristic values of these materials can be taken from Table 2.

Table 1 lists the comparison alloys with the sample identifiers 1 through 5, and the alloys composed according to the invention with the sample identifiers A through E. The test results of the materials can be taken from Table 2. These results will be discussed briefly below.

The alloys 1 through 3 have low nitrogen contents, and therefore show no desired hardening during a cold forming, as revealed by the $R_{P0.2}$ values, and low numerical values of ±270, 210 and 290 N/mm$^2$ were also ascertained for the fatigue strength under reversed stresses (not given in the table).

In corrosion chemistry terms neither the SCC nor the CPT values are adequate, which can be attributed in particular to the respective low Mo contents and, in the case of material 2, to a low Cr content.

The alloys 4 and 5 have a not sufficiently high and an excessive nitrogen concentration, which leads to higher yield point values and also increases the value for the fatigue strength under reversed bending stresses (±308, 340 N/mm$^2$). Due to a low Cr content, there is a disadvantageous DUAL microstructure (etching on the grain boundaries) in material 4, and it should be further noted that, despite adequate Mo concentrations due to the lower Cr contents, material 5 does not meet the requirements for corrosion-resistance, either. The results for alloys A through E show that the nitrogen contents lead to a desired hardening by a cold forming, and the respective concentrations of nitrogen, nickel and molybdenum synergistically give rise to a high corrosion resistance of the material in chloride-containing media, in particular a high resistance to pitting.

TABLE 1

| | Chemical Composition | | | | | | | | 1. Step/Hot Forming | | | 2. Step | |
|---|---|---|---|---|---|---|---|---|---|---|---|---|---|
| Sample | C | Si | Mn | Cr | Ni | Mo | Cu | N | Degree of Forming (-fold) | Forming Temp. [° C.] | Cooling | Forming (%) | Forming Temp. [° C.] |
| 1 | 0.02 | 0.31 | 1.92 | 27.20 | 30.66 | 0.30 | 0.60 | 0.02 | 4.5 | 1050/980 | air | 15 | 450 |
| 2 | 0.05 | 0.40 | 1.30 | 17.52 | 10.20 | 0.05 | 0.05 | n.d. | 5.0 | 1070/910 | water | n.d. | n.d. |
| 3 | 0.025 | 0.41 | 2.51 | 25.28 | 28.07 | 0.35 | n.d. | 0.08 | 5.2 | 1050/900 | air | 18 | 460 |
| A | 0.03 | 0.35 | 1.81 | 26.60 | 28.52 | 3.31 | 1.24 | 0.18 | 5.0 | min. 850 | water | 15 | 480 |
| B | 0.025 | 0.28 | 2.25 | 27.44 | 34.58 | 3.78 | 1.30 | 0.21 | 5.8 | min. 850 | water | 20 | 470 |
| C | 0.02 | 0.30 | 1.10 | 27.28 | 31.20 | 5.12 | 1.05 | 0.20 | 5.5 | min. 850 | water | 18 | 470 |
| D | 0.025 | 0.28 | 1.60 | 30.56 | 35.38 | 2.20 | 0.70 | 0.28 | 5.2 | min. 850 | water | 15 | 450 |
| E | 0.02 | 0.30 | 2.61 | 27.10 | 29.32 | 2.71 | 0.62 | 0.29 | 5.0 | min. 850 | water | 20 | 480 |
| 4 | 0.01 | 0.6 | 1.7 | 17.30 | 13.20 | 2.7 | 0.01 | 0.16 | 5.0 | 1080/950 | air | 8 | 350 |
| 5 | 0.02 | 1.4 | 0.8 | 23.50 | 15.36 | 1.4 | 0.01 | 0.30 | 4.8 | n.d. | n.d. | n.d. | n.d. |

A, B, C, D, E = materials according to the invention
1 to 5 = comparison materials

TABLE 2

| Sample | Rel. Magn. Permeability [$\mu r$] | $R_{P0.2}$ [N/mm$^2$] | Rm [N/mm$^2$] | Toughness (ISO-V) 20° C. [Joule] | FATT [° C.] | Oxalic Acid Test ASTM-A262 | SCC 45% $MgCl_2$ | Pitting CPT 22% NaCl |
|---|---|---|---|---|---|---|---|---|
| 1 | 1.003 | 470 | 780 | 150 | −45 | STEP | 200 MPa/min. 720$^h$ | max. 5° C. |
| 2 | 1.002 | 430 | 750 | 170 | −50 | STEP | 100 MPa/min. 8$^h$ | max. 5° C. |
| 3 | 1.003 | 560 | 790 | 160 | −50 | STEP | 150 MPa/min. 720$^h$ | max. 5° C. |
| A | 1.002 | 930 | 1050 | 140 | −45 | STEP | 450 MPa/min. 720$^h$ | 55° C. |
| B | 1.003 | 1010 | 1110 | 120 | −45 | STEP | 550 MPa/min. 720$^h$ | 60° C. |
| C | 1.003 | 940 | 1040 | 107 | −40 | STEP | 650 MPa/min. 720$^h$ | 85° C. |
| D | 1.003 | 980 | 1090 | 99 | −35 | STEP | 600 MPa/min. 720$^h$ | 65° C. |
| E | 1.002 | 1000 | 1150 | 130 | −45 | STEP | 450 MPa/min. 710$^h$ | 65° C. |
| 4 | 1.005 | 670 | 820 | 130 | −40 | DUAL | 100 MPa/min. 720$^h$ | 15° C. |
| 5 | 1.001 | 810 | 910 | 120 | −45 | STEP | 150 MPa/min. 720$^h$ | 35° C. |

A, B, C, D, E = materials according to the invention
1 to 5 = comparison materials

What is claimed is:

1. A material suitable for equipment in oilfield technology, consisting essentially of, in percent by weight:

| | |
|---|---|
| Carbon (C) | ≦0.03 |
| Silicon (Si) | ≦0.89 |
| Manganese (Mn) | 0.51 to 4.49 |
| Chromium (Cr) | 25.1 to 38.9 |
| Molybdenum (Mo) | 2.1 to 5.9 |
| Nickel (Ni) | 22.9 to 38.9 |
| Copper (Cu) | 0.51 to 1.49 |
| Nitrogen (N) | 0.17 to 0.29 |

with the balance iron and contaminants due to manufacture, which material is hot formed in a condition free of nitride precipitates and without precipitated associated phases and, after a cooling, cold formed in a condition free of ferrites, and having a relative magnetic permeability of less than 1.0048 $\mu r$, a yield strength ($R_{p0.2}$) of higher than 710 N/mm$^2$, a notched impact strength of higher than 60 J, a fatigue strength under reversed stresses of at least ±310 N/mm$^2$ at N=10$^7$ load reversal, and a fracture appearance transition temperature (FATT) of below −28° C.

2. The material of claim 1, wherein the C content is ≦0.02 percent by weight.

3. The material of claim 1, wherein the Si content is ≦0.75 percent by weight.

4. The material of claim 1, wherein the Mn content is 1.1 to 2.9 percent by weight.

5. The material of claim 1, wherein the Cr content is 26.1 to 27.9 percent by weight.

6. The material of claim 1, wherein the Mo content is 2.9 to 5.9 percent by weight.

7. The material of claim 1, wherein the Ni content is 27.9 to 32.5 percent by weight.

8. The material of claim 1, wherein the Cu content is 0.98 to 1.45 percent by weight.

9. The material of claim 1, wherein the N content is 0.175 to 0.29 percent by weight.

10. The material of claim 2, wherein the C content is 0.01 to 0.02 percent by weight.

11. The material of claim 3, wherein the Si content is 0.20 to 0.70 percent by weight.

12. The material of claim 4, wherein the Mn content is 2.01 to 2.6 percent by weight.

13. The material of claim 5, wherein the Cr content is 26.5 to 27.5 percent by weight.

14. The material of claim 6, wherein the Mo content is 3.2 to 3.8 percent by weight.

15. The material of claim 7, wherein the Ni content is 30.9 to 32.1 percent by weight.

16. The material of claim 8, wherein the Cu content is 1.0 to 1.4 percent by weight.

17. The material of claim 1, wherein the N content is 0.18 to 0.22 percent by weight.

18. The material of claim 1, containing, in percent by weight:

| | |
|---|---|
| C | ≦0.02 |
| Si | ≦0.75 |
| Mn | 1.1 to 2.9 |
| Cr | 26.1 to 27.9 |
| Mo | 2.9 to 5.9 |
| Ni | 27.9 to 32.5 |
| Cu | 0.98 to 1.45 |
| N | 0.175 to 0.29. |

19. The material of claim 18, containing, in percent by weight:

| | |
|---|---|
| C | 0.01 to 0.02 |
| Si | 0.20 to 0.70 |
| Mn | 2.01 to 2.6 |
| Cr | 26.5 to 27.5 |
| Mo | 3.2 to 3.8 |
| Ni | 30.9 to 32.1 |
| Cu | 1.0 to 1.4 |
| N | 0.18 to 0.22. |

20. The material of claim 1, wherein the material is hot formed at least 3.6-fold.

21. The material of claim 20, wherein the material is cold formed with a degree of forming of less than 38%.

22. The material of claim 21, wherein the degree of forming is 6 to 19%.

23. The material of claim 21, wherein the material is cold formed at a temperature ranging from 100 to 590° C.

24. The material of claim 22, wherein the material is cold formed at a temperature ranging from 360 to 490° C.

25. The material of claim 19, wherein the material is hot formed at least 3.6-fold and is cold formed with a degree of forming of 6 to 19% at a temperature ranging from 360 to 490° C.

26. The material of claim 1, wherein the material has a pitting potential in a neutral solution at room temperature of at least one of more than 1,100 mVH/1,000 ppm chlorides and more than 1,000 mVH/80,000 ppm chlorides.

27. The material of claim 25, wherein the material has a pitting potential in a neutral solution at room temperature of at least one of more than 1,100 mVH/1,000 ppm chlorides and more than 1,000 mVH/80,000 ppm chlorides.

28. A drilling line component which comprises the material of claim 1.

29. A drilling line component which comprises the material of claim 25.

30. A drill stem which comprises the material of claim 18.

31. A process for making a material suitable for equipment in oilfield technology and having a relative magnetic permeability of less than 1.0048 $\mu r$, a yield strength ($R_{p0.2}$) of higher than 710 N/mm$^2$, a notched impact strength of higher than 60 J, a fatigue strength under reversed stresses of at least ±310 N/mm$^2$ at N=10$^7$ load reversal and a fracture appearance transition temperature (FATT) of below −28° C., said process comprising hot forming a material consisting essentially of, in percent by weight:

| | |
|---|---|
| Carbon (C) | ≦0.03 |
| Silicon (Si) | ≦0.89 |
| Manganese (Mn) | 0.51 to 4.49 |
| Chromium (Cr) | 25.1 to 38.9 |
| Molybdenum (Mo) | 2.1 to 5.9 |
| Nickel (Ni) | 22.9 to 38.9 |
| Copper (Cu) | 0.51 to 1.49 |
| Nitrogen (N) | 0.17 to 0.29 |

with the balance iron and contaminants due to manufacture, in a condition free of nitride precipitates and without precipitated associated phases and, after a cooling, cold forming the material in a condition free of ferrites.

32. The process of claim 31, wherein the material contains, in percent by weight:

| | |
|---|---|
| C | ≦0.02 |
| Si | ≦0.75 |
| Mn | 1.1 to 2.9 |
| Cr | 26.1 to 27.9 |
| Mo | 2.9 to 5.9 |
| Ni | 27.9 to 32.5 |
| Cu | 0.98 to 1.45 |
| N | 0.175 to 0.29. |

33. The process of claim 32, wherein the material contains, in percent by weight:

| | |
|---|---|
| C | 0.01 to 0.02 |
| Si | 0.20 to 0.70 |
| Mn | 2.01 to 2.6 |
| Cr | 26.5 to 27.5 |
| Mo | 3.2 to 3.8 |
| Ni | 30.9 to 32.1 |
| Cu | 1.0 to 1.4 |
| N | 0.18 to 0.22. |

34. The process of claim 32, wherein the material is hot formed at least 3.6-fold.

35. The process of claim 34, wherein the material is cold formed with a degree of forming of less than 38%.

36. The process of claim 35, wherein the degree of forming is 6 to 19%.

37. The process of claim 35, wherein the material is cold formed at a temperature ranging from 100 to 590° C.

38. The process of claim 36, wherein the material is cold formed at a temperature ranging from 360 to 490° C.

39. The process of claim 33, wherein the material is hot formed at least 3.6-fold and is cold formed with a degree of forming of 6 to 19% at a temperature ranging from 360 to 490° C.

40. The process of claim 32, wherein the material suitable for equipment in oilfield technology is a drill line component.

* * * * *

UNITED STATES PATENT AND TRADEMARK OFFICE

CERTIFICATE OF CORRECTION

PATENT NO. : 6,764,647 B2
DATED : July 20, 2004
INVENTOR(S) : H. Aigner et al.

It is certified that error appears in the above-identified patent and that said Letters Patent is hereby corrected as shown below:

Title page,
Item [73], Assignees, "Choeller-Bleckmann" should be -- Schoeller-Bleckmann -- and "Kohler" should be -- Bohler --.

Signed and Sealed this

Twenty-first Day of December, 2004

JON W. DUDAS
*Director of the United States Patent and Trademark Office*